United States Patent [19]

Hill

[11] Patent Number: 4,942,892

[45] Date of Patent: Jul. 24, 1990

[54] HAIR-CURLING DEVICE

[76] Inventor: Jill M. Hill, 264 Lowena Dr., Long Beach, Calif. 90803

[21] Appl. No.: 317,096

[22] Filed: Feb. 28, 1989

Related U.S. Application Data

[63] Continuation of Ser. No. 161,544, Feb. 29, 1988, abandoned.

[51] Int. Cl.[5] ..... A45D 2/20

[52] U.S. Cl. ..... 132/247

[58] Field of Search ..... 132/245, 247, 249, 251, 132/255, 256, 260, 281, 284

[56] References Cited

U.S. PATENT DOCUMENTS

| | | | |
|---|---|---|---|
| 1,009,923 | 11/1911 | Moll | 132/247 |
| 1,240,508 | 9/1917 | Stevenson | 132/247 |
| 2,349,895 | 5/1944 | Whittaker | 132/247 |
| 2,388,797 | 11/1945 | Panushka et al. | 132/247 |
| 2,415,914 | 2/1947 | Silverman | 132/247 |
| 2,422,716 | 6/1947 | Broyles | 132/247 |
| 4,022,226 | 5/1977 | Muenstermann | 132/245 |
| 4,141,370 | 2/1979 | Haas | 132/245 |
| 4,141,371 | 2/1979 | Gangnath | 132/245 |
| 4,310,008 | 1/1982 | Lalli | 132/247 |
| 4,353,380 | 10/1982 | Kolkmann | 132/256 |

FOREIGN PATENT DOCUMENTS

| | | | |
|---|---|---|---|
| 705559 | 6/1931 | France | 132/247 |
| 1005019 | 4/1952 | France | 132/247 |

*Primary Examiner*—John J. Wilson
*Assistant Examiner*—Michael Lynch
*Attorney, Agent, or Firm*—Christie, Parker & Hale

[57] ABSTRACT

A hair-curling device for use in creating Z-shaped, angular or squared curls in the hair comprises a long double-hinged flat curler which includes an elongated flat rectangular main body and a pair of end flaps integrally attached to the ends of the main body by thin, narrow folding hinges. An elongated C-shaped locking receptacle extends along a free end of one end flap, and a cylindrical solid locking member extends along a free end of the other end flap. The hair is wrapped around the main body portion of the curler and the end flaps are then folded over the same side of the main body portion and interlocked in a snap fit by finger pressure applied to the end flaps. The end flaps, including the locking member and receptable, are together slightly longer than the main body of the curler, and the main body of the curler is slightly flexible laterally, so that the locking portions of the end flaps can be snapped together when the aligned end flaps are pressed down against the main body member.

9 Claims, 1 Drawing Sheet

HAIR-CURLING DEVICE

CROSS-REFERENCE TO RELATED APPLICATIONS

This is a continuation of application Ser. No. 07/161,544, filed 02/29/88, now abandoned.

FIELD OF THE INVENTION

This invention relates to a hair-curling device which is wound around the hair similar to a conventional cylindrical curling device, but is used to create Z-shaped, angular or squared curls in the hair in either a temporary or permanent basis.

BACKGROUND OF THE INVENTION

For the past fifty years or so, the most popular and easiest method used to produce curls was with a cylindrical hair-curling device or a conventional permanent wave rod. However, these devices are only able to make round S-shaped curls in the hair. The concept of using a flat curling device is new because it was only recently that highly textured hair became quite popular, and with this comes a need to change the conventional way of curling the hair.

The present invention provides a flat hair-curling device that makes Z-shaped, angular or squared curls, so that the hair dresser can now create a variety of curl textures in the hair. Z-shaped, angular or squared curls have been created with various curling devices which are unmarketable, time consuming to use, or involve unprofessional techniques. Prior use of tongue depressors or flattened tint tubes are examples. A curling iron also is available for making angular curls, but the device is very time consuming and difficult to use, and the effect lasts only for a short time, usually only one day.

The unique and simple curling device of the present invention can supersede all methods now being used and thus open the doors of creativity and imagination to all hair dressers, rather than a few trendsetters, by making readily available a device which enables hair dressers to achieve the now popular textured curl. Other advantages over previous techniques are its unlimited reusability, its availability in an unbreakable variety of different curler sizes, and the fact that it is much quicker and easier to use.

Therefore, it is an object of this invention to replace previous methods and devices used in creating Z-shaped, angular or squared curls.

SUMMARY OF THE INVENTION

Briefly, one embodiment of the present invention provides a flat hair curler for use in creating Z-shaped, angular or squared curls in the hair, comprising an elongated and substantially flat main body portion; a first end flap hinged by a narrow folding hinge to a first end of the main body; and a second end flap hinged by a similar narrow folding hinge to a second end of the main body. An elongated locking receptacle of generally C-shaped configuration faces outwardly and extends along a free end of the first end flap. An elongated locking member extends along a free end of the second flap and is shaped to match the interior contour of the receptacle for frictionally interlocking with the receptacle. The first and second end flaps together are at least as long as the main body. When folded about their respective hinges, they overlie the main body of the curling device and interlock at their ends. The locking member and the receptacle are interlocked frictionally by compression in a snap fit when the locking member and receptacle member are aligned and the end flaps are pressed down toward the main body. This interlocking snap fit holds the curler wrapped around the hair in the space between the flat main body and the interlocked end flaps. A permanent wave solution then may be applied to the rolled-up portion of the hair contained within the interlocked curler.

DETAILED DESCRIPTION

Figure 1:
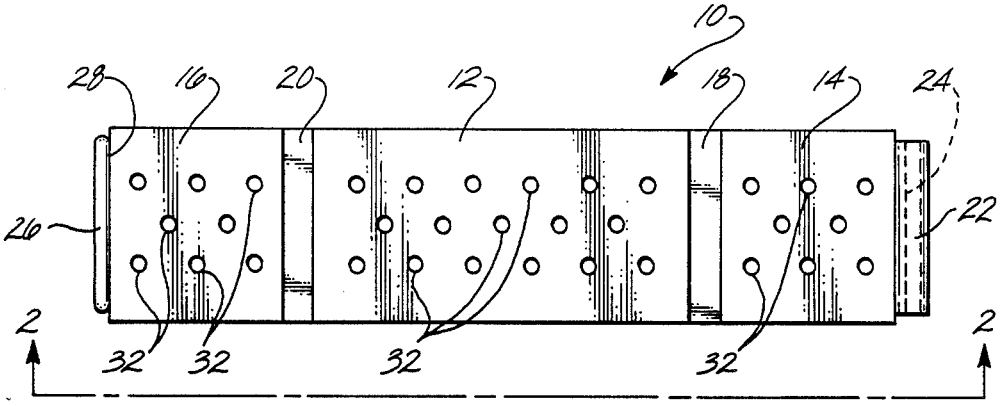
FIG. 1 is a top plan view illustrating a flat hair-curling device according to principles of this invention.
Figure 2:
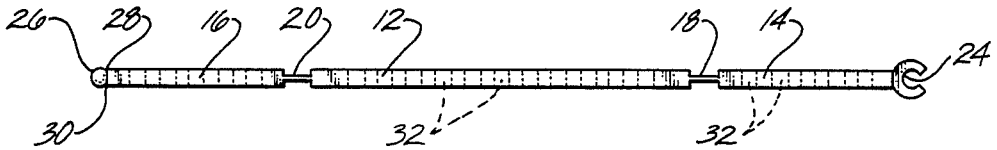
FIG. 2 is an end view taken on line 2—2 of FIG. 1.

Referring to the drawings, a flat hair-curling device 10, according to principles of this invention, comprises a thin, flat elongated rectangular main body portion 12; a thin, flat first rectangular flap 14 hinged to a first end of the main body 12; and a thin flat second rectangular flap 16 hinged to an opposite second end of the main body 12. The first and second end flaps 14 and 16 are hinged to the opposite ends of the flat main body portion of the device by corresponding narrow, flat folding hinges 18 and 20 substantially thinner in cross section than the end flaps and the main body portion of the device.

An elongated cylindrical locking receptacle 22 of C-shaped cross section extends along the free end of the first flap. The locking receptacle is of uniform size and shape and extends substantially the entire length of the free end of the flap. The narrow C-shape groove 24 formed internally within the locking receptacle faces outwardly away from the main body of the device.

An elongated cylindrical solid locking member 26 extends along the free end of the second end flap. This locking member is of cylindrical cross section end-to-end, and is shaped to match the interior contour of the locking receptacle 22. The locking member 26 has a maximum width slightly greater than the thickness of the end flap with which it is formed. At its point of connection to the end flap, it is thinned down in width to form a pair of thin, elongated grooves 28 and 30 on opposite sides of the junction between the ends of the second end flap and the locking member 26.

Preferably, the flat hair curling device is made from a semirigid plastic material and the device is molded as an integral one-piece unit. In this embodiment, the hinged sections are of the "living hinge" type which allows continuous folding of each end flap in either clockwise or counterclockwise directions about the axis of the hinge. The living hinge allows each end flap to be easily folded over to lie against either the top or bottom portion of the main body portion of the device.

Figure 3:
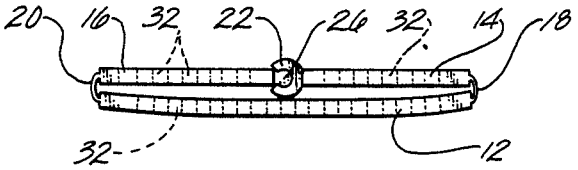
FIG. 3 is an end view showing an intermediate step in the process of interlocking the ends of the hair-curling device.

The semirigid plastic material allows the long main body portion to be rigid lengthwise while it can be flexed slightly in a lateral direction as shown in FIG. 3. The end flaps are rigid longitudinally and also can be flexed slightly laterally as shown in FIG. 3. A preferred plastic material is low-density polyethylene although other plastic materials also can be used.

The hair-curling device also includes a desired pattern of drainage holes 32 molded in and extending entirely through the depth of the main body portion and the end flaps of the device.

The end flaps are positioned at the ends of the main body portion so that they can be folded about their respective hinges toward the midpoint of the main body of the curler. In one embodiment, the end flaps (not including the width of the locking members 22 and 26) each extend about one-half the length of the main body. When the thicknesses of the locking member and locking receptacle are included, each end flap is slight longer than one-half the length of the main body.

Figure 4:
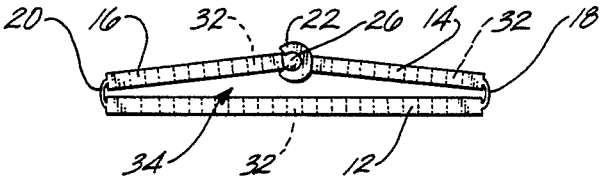
FIG. 4 is an end view illustrating the interlocked hair-curling device.

In use, after the hair is wrapped around the flap of the main body of the hair-curling device, the locking member 22 and receptacle 26 are then aligned with each other, and the end flaps are then pressed downwardly (with finger pressure) toward the main body of the curling device. This forces the locking member 26 into the interior of the C-shaped locking receptacle 22 by compression to make an instantaneous frictional interlocking snap fit to firmly hold the ends of the end flaps together. When the finger pressure is removed, the curler quickly returns to its locked position shown in FIG. 4 with a narrow space 34 between the main body 12 and the interlocked end flaps 14 and 16. This space provides room for the hair which has been wrapped around the body and allows permanent wave solutions to be applied in the end spaces of the curler. The hole pattern in the curler allows for drainage of permanent wave solution and for air flow through the device for curling.

The interlocked hair-curling device clamps tightly to the hair and does not slip during use. Typically, three to four dozen hair curlers of this type are commonly used in a hair curling operation. The hair curler can be quickly and easily applied and also quickly and easily removed once the hair curling is completed. The long, flat edges of the thin, flat main body portion create good Z-shaped, angular or squared curls on a permanent or temporary basis.

What is claimed is:

1. A hair curler for use in creating Z-shaped, angular or squared curls in the hair comprising:

an elongated substantially flat main body portion;

a first end flap hinged by a thin narrow folding hinge to a first end of the main body;

a second end flap hinged by a thin narrow folding hinge to a second end of the main body;

an elongated locking receptacle of generally C-shaped configuration facing outwardly and extending along a free end of the first end flap; and an elongated locking member extending along a free end of the second flap and shaped to match the contour of the locking receptacle for forming a frictional interlocking fit with the receptacle under compression;

the first and second end flaps together having a length at least that of the main body when folded back about their respective hinges to overlie the same side of the main body, the locking member and receptacle being interlocked fictionally by compression in a snap fit when the locking member and receptacle are aligned and the end flaps then pressed downwardly toward the main body to thereby fictionally snap the locking member into engagement with the receptacle and thereby hold the device wrapped around hair in the space between the interlocked end flaps and the main body of the hair-curling device.

2. Apparatus according to claim 1 in which the main body is elongated and generally rectangular and has generally straight side edges.

3. Apparatus according to claim 2 in which the end flaps and the main body are substantially wider than their thickness, and each has generally straight side edges.

4. Apparatus according to claim 1 in which the main body and the end flaps include drainage holes.

5. Apparatus according to claim 1 in which the locking member is a solid cylindrical member of uniform size projecting from the end of the second end flap.

6. Apparatus according to claim 5 in which the locking receptacle has a cylindrical-shaped recess.

7. Apparatus according to claim 1 in which the end flaps, including the locking member and the locking receptacle, are together longer than the main body, to allow a space into which the end flaps can be pressed toward the main body to form the interlocking snap fit.

8. Apparatus according to claim 1 in which the hair-curling device is integrally molded as a plastic one-piece unit.

9. Apparatus according to claim 8 in which the folding hinges comprise living hinges.

* * * * *

UNITED STATES PATENT AND TRADEMARK OFFICE

CERTIFICATE OF CORRECTION

PATENT NO. : 4,942,892

DATED : July 24, 1990

INVENTOR(S) : Jill M. Hill

It is certified that error appears in the above-identified patent and that said Letters Patent is hereby corrected as shown below:

Column 1, line 28, change "hair dresser" to -- hairdresser --.

Column 1, lines 40 and 41, change "hair dressers" to -- hairdressers -- (both occurrences).

Column 3, line 12, change "slight" to -- slightly --.

Column 3, line 32, change "air flow" to -- airflow --.

In the Claims:

Column 4, line 5, after "flap;" delete -- and --.

Column 4, line 10, after "compression;" insert -- and --.

Column 4, line 15, change "fictionally" to -- frictionally --.

Column 4, line 19, change "fictionally" to -- frictionally --.

Signed and Sealed this

Twelfth Day of May, 1992

*Attest:*

DOUGLAS B. COMER

*Attesting Officer*

*Acting Commissioner of Patents and Trademarks*